US008169291B2

(12) United States Patent
Cheng et al.

(10) Patent No.: US 8,169,291 B2
(45) Date of Patent: May 1, 2012

(54) COMBINATION-TYPE FUSE

(76) Inventors: Wen-Tsung Cheng, Taoyuan County (TW); Wen-Ho Cheng, Taoyuan County (TW)

( * ) Notice: Subject to any disclaimer, the term of this patent is extended or adjusted under 35 U.S.C. 154(b) by 247 days.

(21) Appl. No.: 12/652,966

(22) Filed: Jan. 6, 2010

(65) Prior Publication Data

US 2011/0163838 A1 Jul. 7, 2011

(51) Int. Cl.
*H01H 85/175* (2006.01)
*H01H 85/153* (2006.01)

(52) U.S. Cl. ..... 337/186; 337/187; 337/198

(58) Field of Classification Search ..... 337/187, 337/198, 241, 242, 265, 266
See application file for complete search history.

(56) References Cited

U.S. PATENT DOCUMENTS 4,224,592 A * 9/1980 Urani et al. ..... 337/198
4,281,322 A * 7/1981 Nasu et al. ..... 340/638
4,308,516 A * 12/1981 Shimada et al. ..... 337/241
4,349,804 A * 9/1982 Gaia ..... 337/198
4,391,485 A * 7/1983 Urani ..... 439/687
4,499,447 A * 2/1985 Greenberg ..... 337/266
4,695,815 A * 9/1987 Hwang ..... 337/266
4,712,081 A * 12/1987 Bosley ..... 337/266
4,772,219 A * 9/1988 Falchetti ..... 439/490
4,815,993 A * 3/1989 Falchetti ..... 439/620.33
4,941,851 A * 7/1990 Hsueh ..... 439/620.34
5,004,995 A * 4/1991 Lo ..... 337/266
5,139,443 A * 8/1992 Armando ..... 439/620.26
5,239,282 A * 8/1993 Filomia ..... 337/255
5,311,139 A * 5/1994 Fogal ..... 324/550
5,598,138 A * 1/1997 Jaronczyk, Jr. ..... 337/265
5,629,664 A * 5/1997 Muramatsu et al. ..... 337/261
5,701,118 A * 12/1997 Hull et al. ..... 340/638
5,818,320 A * 10/1998 Matsuoka ..... 337/198
5,874,884 A * 2/1999 Hull et al. ..... 337/241
6,359,543 B2 3/2002 Endo et al.
6,448,897 B1 * 9/2002 Ku ..... 340/638
6,496,096 B2 * 12/2002 Kondo et al. ..... 337/234
6,556,121 B2 * 4/2003 Endo et al. ..... 337/260
6,753,753 B2 * 6/2004 Endo et al. ..... 337/198
6,836,206 B2 * 12/2004 Lee ..... 337/243
7,126,488 B1 * 10/2006 May ..... 340/638
7,339,486 B2 * 3/2008 Huang ..... 340/638
7,460,004 B1 * 12/2008 Yang ..... 337/206
7,479,866 B2 * 1/2009 Goldsberry et al. ..... 337/198
7,772,959 B2 * 8/2010 Cheng et al. ..... 337/242
2003/0179070 A1 * 9/2003 Izumi ..... 337/255
2005/0035842 A1 * 2/2005 Shyu ..... 337/265
2005/0206492 A1 * 9/2005 Chao ..... 337/198
2005/0212647 A1 * 9/2005 Goldsberry et al. ..... 337/198
2006/0017540 A1 * 1/2006 Smith ..... 337/242
2010/0033292 A1 * 2/2010 Cheng et al. ..... 337/241
2010/0033293 A1 * 2/2010 Cheng et al. ..... 337/241

* cited by examiner

*Primary Examiner* — Anatoly Vortman
(74) *Attorney, Agent, or Firm* — Chun-Ming Shih; HDLS IPR Services

(57) ABSTRACT

A fuse includes an insulating base and a conducting terminal installed in the insulating base, and the insulating base is integrally formed and includes a groove and two concave pits interconnected to the groove. The conducting terminal is accommodated in the groove, and includes two conductive handles, a fuse filament coupled to the two conductive handles, and a forked holding portion formed at an end of each conductive handle and fixed into the concave pit. The forked holding portion is compressed, and a surface of the insulating base is stamped, such that the conducting terminal is passed and fixed securely to the insulating base, and the fuse features a simple structure and an easy installation.

7 Claims, 5 Drawing Sheets

COMBINATION-TYPE FUSE

BACKGROUND OF THE INVENTION

1. Field of the Invention

The present invention relates to a fuse, and more particularly to a combination-type fuse.

2. Description of Prior Art

Fuse is an over-current protection device generally used in an electric appliance or a circuit, and a fuse filament of the fuse melts or the fuse blows to prevent over-current from damaging electronic components installed in the electric appliance, since current will be increased if the electric appliance breaks down or the circuit fails to operate normally, and the current passed through the electric appliance or circuit will exceed a loading limit of the fuse. Therefore, the fuse can achieve the effects of protecting electric appliances and circuits.

As disclosed in U.S. Pat. No. 6,359,543, a conventional combination-type fuse comprises a conducting terminal and two casing plates, and the two casing plates include electrically conductive plates passed through the two casing plates and engaged with each other, such that the electrically conductive plates are fixed inside the fuse. However, the two casing plates of the fuse of this sort may be loosened or separated easily, and the positions of the electrically conductive plates may be deviated easily, and thus affecting the normal operation of the fuse. Furthermore, the two casing plates are made from two different molds, not only incurring a higher molding cost, but also taking a longer assembling time and requiring a higher manufacturing cost.

SUMMARY OF THE INVENTION

Therefore, it is a primary objective of the present invention to provide a combination-type fuse featuring a simple structure and an easy installation to reduce the manufacturing cost.

Another objective of the present invention is to provide a combination-type fuse, whose conducting terminal is passed and fixed securely to the insulating base.

To achieve the foregoing objective, the present invention provides a combination-type fuse comprising an insulating base and a conducting terminal, and the insulating base is integrally formed and includes a groove and two concave pits interconnected to the groove, wherein the conducting terminal is accommodated into the groove, and the conducting terminal includes two conductive handles, a fuse filament coupled to the two conductive handles, and a forked holding portion formed at an end of each conductive handle and fixed into the concave pit.

Compared with the prior art, the combination-type fuse of the present invention includes an integrally formed insulating base, such that the fuse will not be loosened or separated easily. In addition, only one mold is required for the manufacture, and thus reducing the molding cost. Since the forked holding portion is formed at an end of the conductive handle, therefore the forked holding portion can be spread open and fixed to the concave pit by compressing the forked holding portion, and the conducting terminal can be combined with the insulating base securely. With such simple assembling process, the assembling time can be reduced, not only improving the yield rate of the fuse, but also lowering the manufacturing cost and enhancing the practicability of the present invention.

DETAILED DESCRIPTION OF THE INVENTION

The technical characteristics, features and advantages of the present invention will become apparent in the following detailed description of the preferred embodiments with reference to the accompanying drawings. The drawings are provided for reference and illustration only, but not intended for limiting the present invention.

Figure 1:
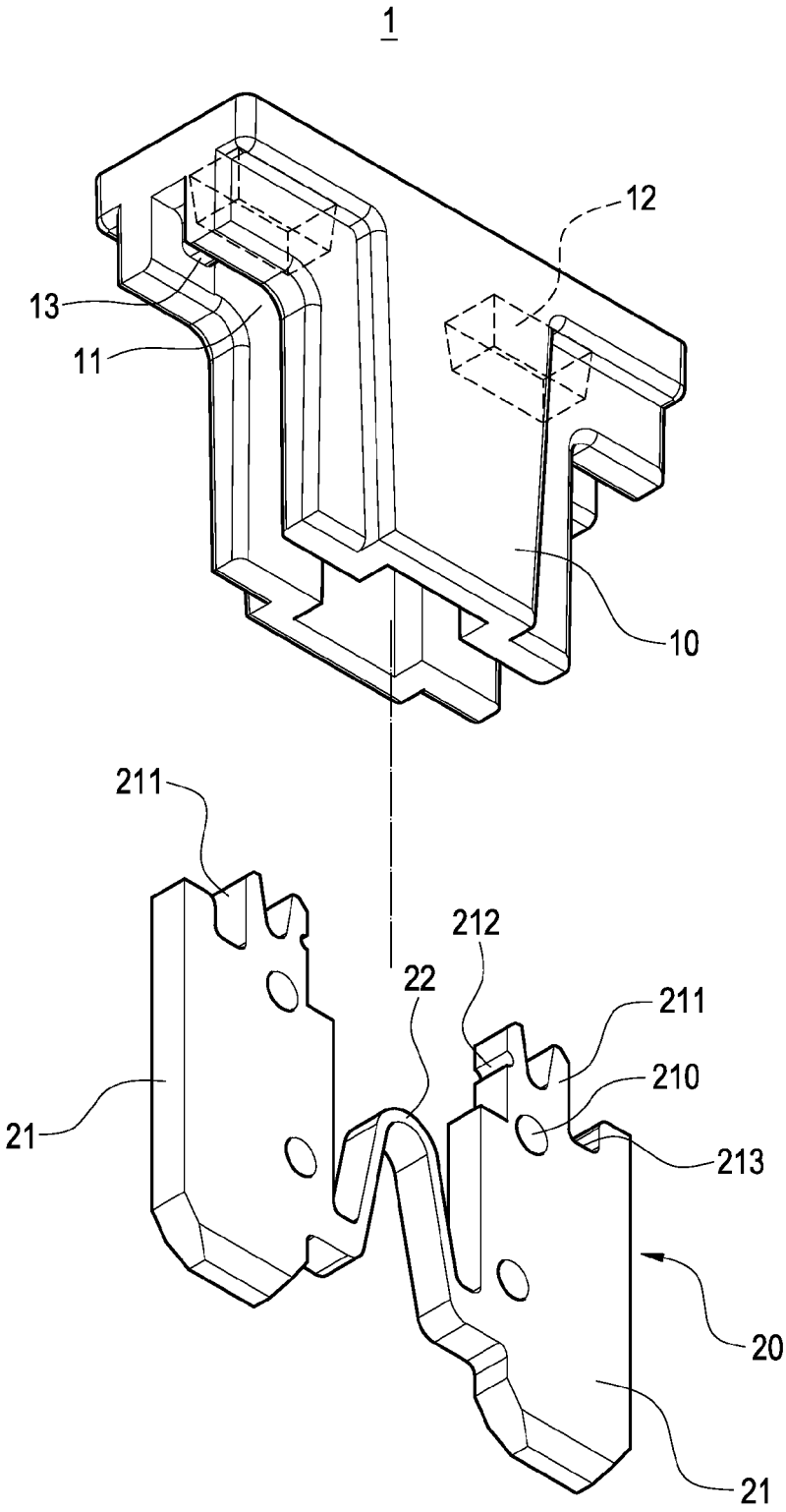
FIG. 1 is a perspective view of a combination-type fuse in accordance with the present invention.
Figure 2:
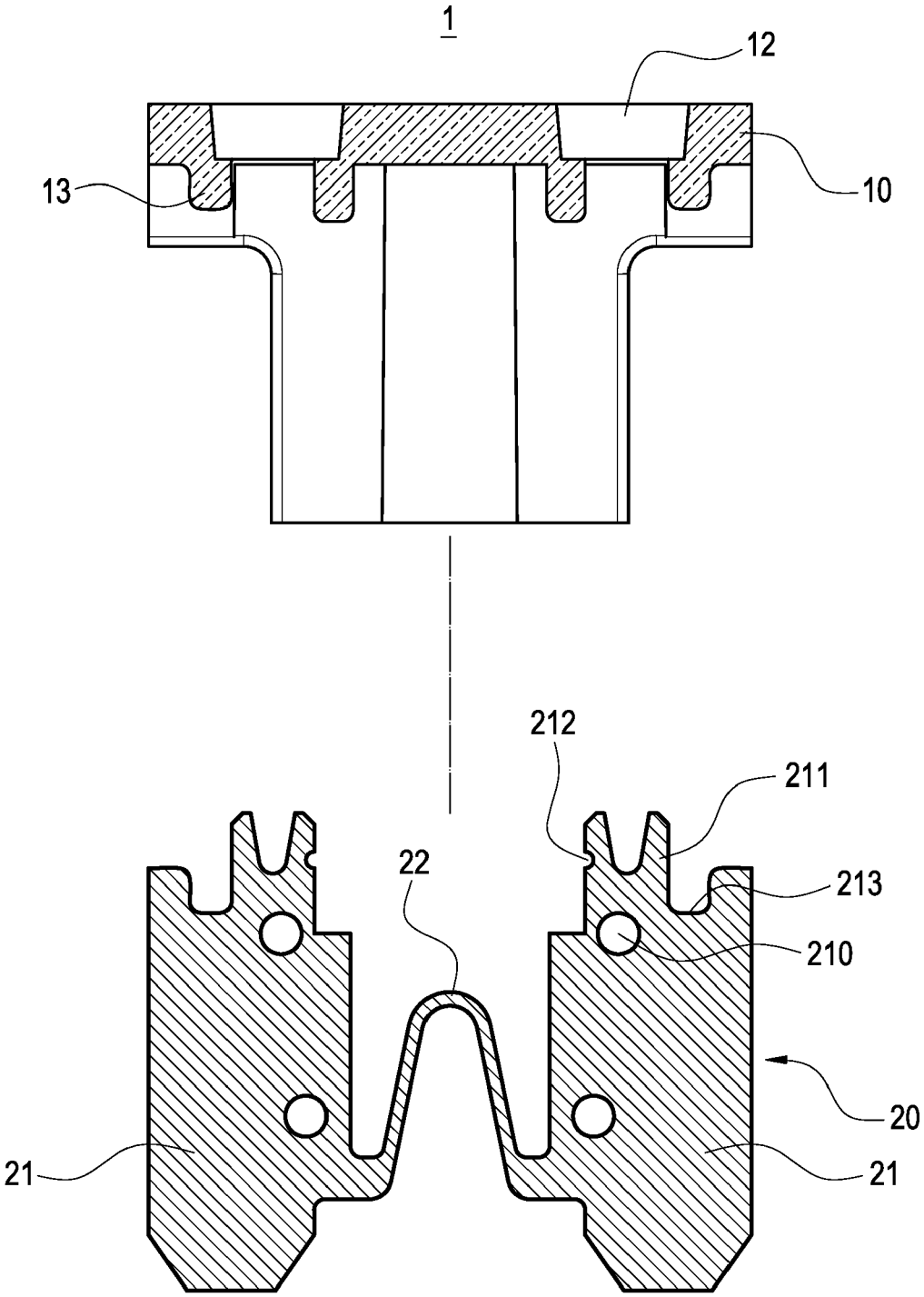
FIG. 2 is a cross-sectional view of a combination-type fuse in accordance with the present invention.

With reference to FIGS. 1 and 2, the combination-type fuse 1 comprises an insulating base 10 and a conducting terminal 20.

The insulating base 10 is an integrally formed T-shaped base, and the insulating base 10 includes a groove 11 and two concave pits 12 interconnected to the groove 11, wherein the insulating base 10 has a block 13 extended into the groove 11, and the two concave pits 12 are arranged linearly at the top side of the insulating base 10, and the groove 11 is arranged parallel to the two concave pits 12, situated at internal sides of the two concave pits 12, and transversely passed through the insulating base 10.

The conducting terminal 20 is an electrically conductive metal plate passed through the bottom side of the insulating base 10 and accommodated into the groove 11, and the conducting terminal 20 includes two conductive handles 21 and a fuse filament 22 connected to the two conductive handles 21, wherein each of the conductive handles 21 has a plurality of through holes 210, and a forked holding portion 211 formed at an end of the conductive handle 21, and the forked holding portion 211 is slightly flexible, such that the forked holding portion 211 will be deformed slightly inward during the installation process and fixed into the concave pit 12 after the deformed forked holding portion 211 resumes its original shape. In addition, the conductive handle 21 includes a notch 212 formed on a side of the conductive handle 21, and the conductive handle 21 includes a positioning slot 213 disposed at a position of the block 13 corresponding to the insulating base 10, and the fuse filament 22 in this preferred embodiment is substantially U-shaped. Of course, the fuse filament 22 can be in other appropriate shapes for other preferred embodiments.

Figure 3:
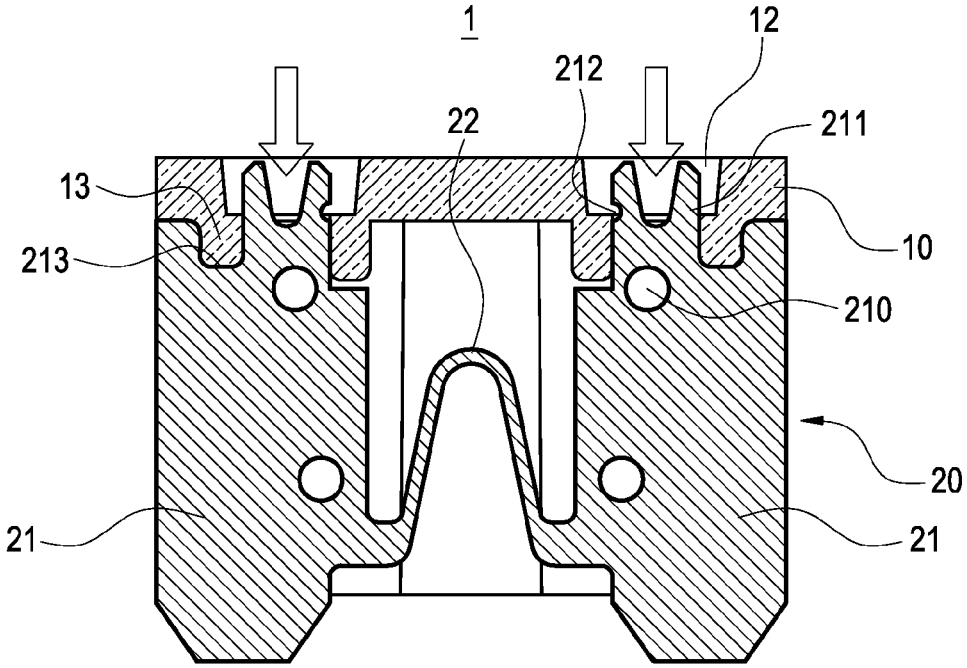
FIG. 3 is a schematic view of compressing a forked holding portion in accordance with the present invention.
Figure 4:
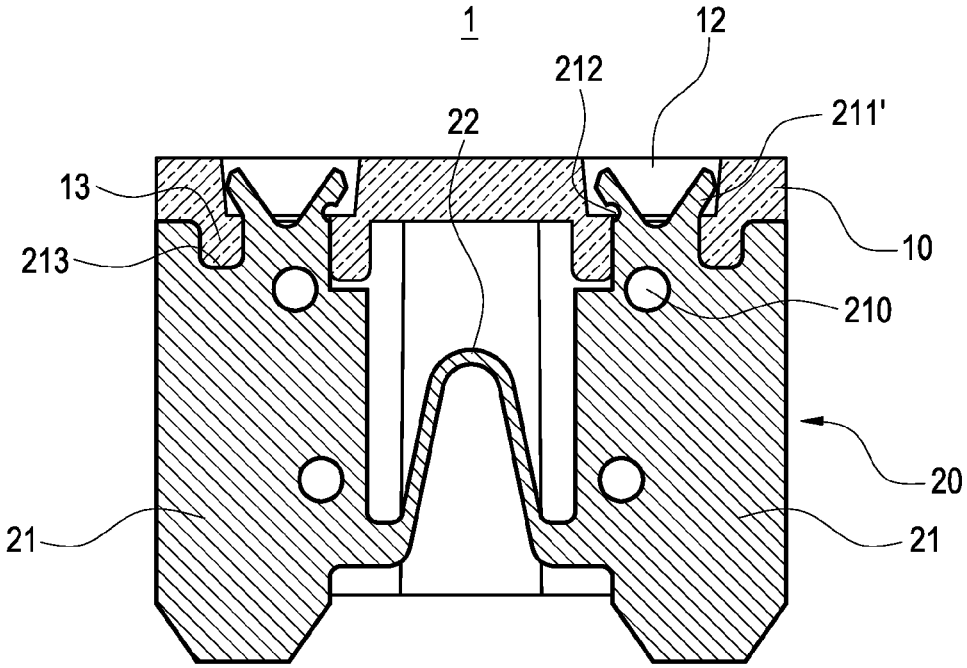
FIG. 4 is a schematic view of spreading open a forked holding portion in accordance with the present invention.

With reference to FIGS. 3 and 4 for a schematic views of compressing a forked holding portion and a compressed forked holding portion in accordance with the present invention respectively, if the conducting terminal 20 is inserted into the groove 11 of the insulating base 10, then the block 13 of the insulating base 10 will be pressed into the positioning slot 213 of the conductive handle 21, and the notch 212 of the conductive handle 21 will be abutted against the bottom side of the concave pit to prevent the forked holding portion 211 from being passed out from the concave pit 12, and the forked holding portion 211 will be positioned into the concave pit 12, and then a tool (not shown in the figure) is used for compressing the two forked holding portions 211, and the two compressed forked holding portions 211 will spread open the forked holding portion 211' and fix the forked holding portion 211' into the concave pit 12.

Figure 5:
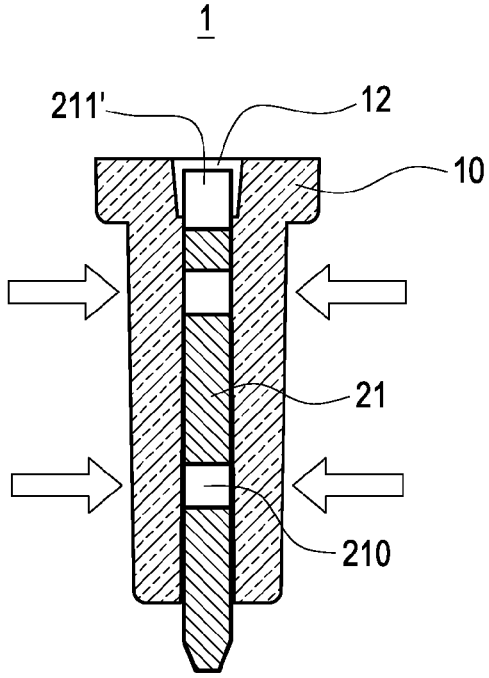
FIG. 5 is a schematic view of stamping a combination-type fuse in accordance with the present invention.
Figure 6:
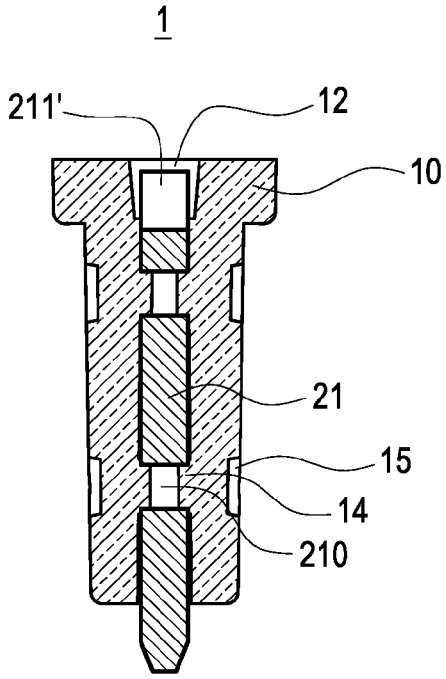
FIG. 6 is a schematic view of a stamped combination-type fuse in accordance with the present invention.

With reference to FIGS. 5 and 6 for schematic views of compressing a forked holding portion and a spread-open forked holding portion in accordance with the present invention respectively, a stamping process is performed at positions of the through holes 210 on a surface of the insulating base 10 and opposite to the conducting terminal 20, such that the insulating base 10 has a plurality of protruding members 14 extended inwardly from the positions of the through holes 210, and a plurality of recesses 15 formed on a surface of the insulating base 10, such that the protruding members 14 can be embedded and fixed into the through holes 210, and the conducting terminal 20 can be passed and fixed into the insulating base 10 more securely.

Figure 7:
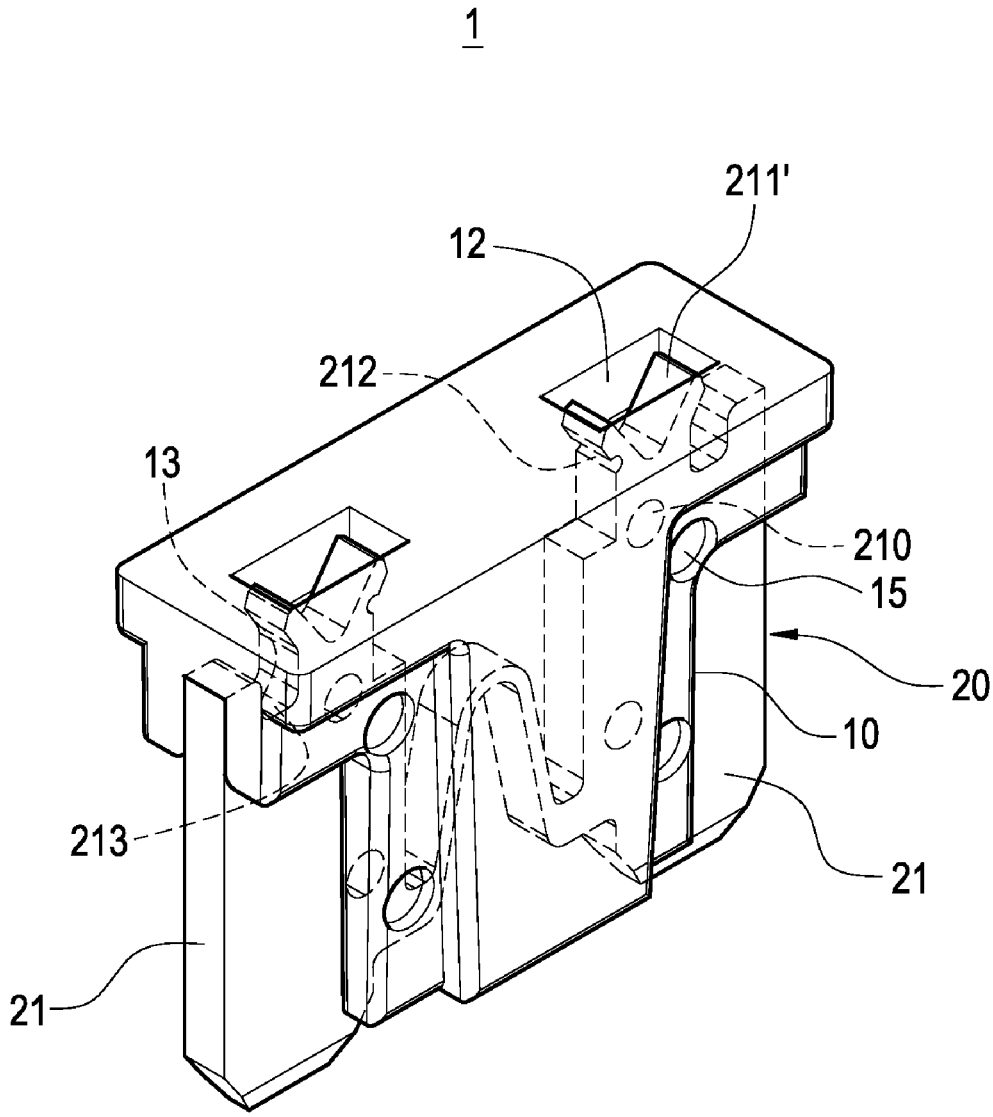
FIG. 7 is a perspective view of stamping a combination-type fuse in accordance with the present invention.

With reference to FIG. 7 for a perspective view of a combination-type fuse in accordance with the present invention, the combination-type fuse 1 is assembled in accordance with the method and procedure as described above.

The present invention is illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A combination-type fuse, comprising:

an insulating base, integrally formed in one piece, and having a top plate, a groove disposed below the top plate, and two concave pits formed in the top plate and interconnected to the groove; and a conducting terminal, accommodated into the groove, and having two conductive handles, a fuse filament coupled to the two conductive handles, and a forked holding portion formed at an end of each of the conductive handles and fixed into the concave pit, wherein a protruding member is protruded from the bottom of the top plate of the insulating base and extended into the groove, a corresponding positioning slot is concaved on the end of one conductive handle, and the protruding member is pressed into the positioning slot.

2. The combination-type fuse of claim 1, wherein the insulating base is substantially T-shaped.

3. The combination-type fuse of claim 1, wherein the groove is disposed parallel to the two concave pits and transversally passed through the insulating base.

4. The combination-type fuse of claim 1, wherein the two conductive handles have a plurality of through holes respectively, and the insulating base includes a protruding member inwardly extended to a position opposite to the through holes by a stamping method, and the protruding members are embedded and fixed into the through holes respectively.

5. The combination-type fuse of claim 1, wherein the fuse filament is substantially U-shaped.

6. The combination-type fuse of claim 1, wherein the forked holding portion includes a notch disposed on a side of the forked holding portion, and abutted at an internal bottom side of the concave pit for positioning the forked holding portion in the concave pit.

7. The combination-type fuse of claim 1, wherein the forked holding portion is spread open and fixed into the concave pit by a compressing method.

* * * * *